US005805114A

United States Patent [19]

Podger

[11] Patent Number: 5,805,114

[45] Date of Patent: Sep. 8, 1998

[54] EXPANDED QUADRUPLE-DELTA ANTENNA STRUCTURE

[76] Inventor: James Stanley Podger, 55 Gradwell Drive, Scarborough, Ontario M1M 2N1, Canada

[21] Appl. No.: 825,922

[22] Filed: Apr. 2, 1997

[30] Foreign Application Priority Data

Jun. 18, 1996 [CA] Canada ..... 2179331

[51] Int. Cl.[6] ..... H01Q 11/12

[52] U.S. Cl. ..... 343/742; 343/866; 343/726

[58] Field of Search ..... 343/741, 742, 343/866, 867, 868, 700 MS, 723, 726

[56] References Cited

U.S. PATENT DOCUMENTS

| | | | |
|---|---|---|---|
| D. 213,375 | 2/1969 | Habig | D26/14 |
| 2,366,195 | 1/1945 | Kandoian | 343/741 |
| 2,537,191 | 1/1951 | Moore | 250/33.67 |
| 3,268,899 | 8/1966 | Walden | 343/741 |
| 3,434,145 | 3/1969 | Wells | 343/726 |
| 4,785,303 | 11/1988 | Clark et al. | 343/742 |
| 4,804,965 | 2/1989 | Roederer | 343/700 MS |
| 5,404,147 | 4/1995 | Drucker et al. | 343/742 |

OTHER PUBLICATIONS

Sykes, B., "The Skeleton Slot Aerial System," *The Short Wave Magazine,* Jan. 1955, pp. 594–598.

Davey, W. W., "Try a Bi–Loop Antenna," 73 *Magazine,* Apr. 1979, p. 58.

Hawker, J. Patrick, "Technical Topics, Double–Delta Aerials for VHF and UHF," *Radio Communications,* Jun. 1969, pp. 396–397.

Belrose, John, "Technical Correspondence, A Half Twin–Delta Loop Array," *QST,* Apr., 1983, pp. 39–40.

Kraus, John D., "A Small But Effective 'Flat Top' Beam," *radio,* Mar. 1937, pp. 56–58.

Orr, William I., "Loop Configuration," *Radio Handbook,* 23rd ed. (Indianapolis: Howard W. Sams & Co., 1987), pp. 22–11/12.

Kraus, John D., "Twin–Three Flat–Top Beam Antenna," *Radio,* Nov. 1939, pp. 10–14 and pp. 81–83.

Podger, J. S., Analysis Results, Quadruple Delta.

Podger, J. S., Analysis Results, Expanded Quadruple Delta.

*Primary Examiner*—Frank G. Font
*Assistant Examiner*—Layla G. Lauchman

[57] ABSTRACT

An antenna structure is disclosed that is a set of approximately coplanar conductors which form four approximately triangular conductors. Three parallel conductors are the central part and the two outer parts. The center points of these parallel conductors are aligned in the direction perpendicular to the parallel conductors. Connected to the central parallel conductor, there are four diagonal conductors which extend toward the outer parallel conductors and almost meet near the line of the centers of the parallel conductors. Extending from the unconnected ends of those diagonal conductors, there are four more diagonal conductors that connect to the outer parallel conductors. The two inner triangular conductors so formed have perimeters of approximately two wavelengths. The two outer triangular conductors so formed have perimeters of approximately one and three quarters wavelengths. Several applications of such antenna structures in various arrays are also disclosed.

50 Claims, 7 Drawing Sheets

Fig. 2
Prior Art
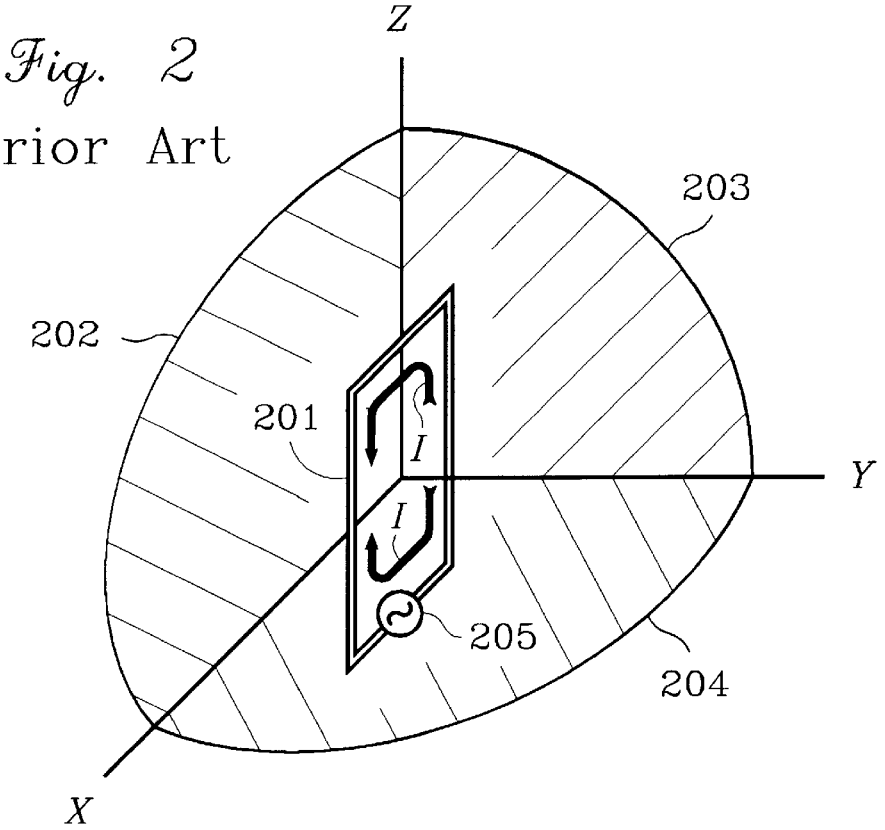
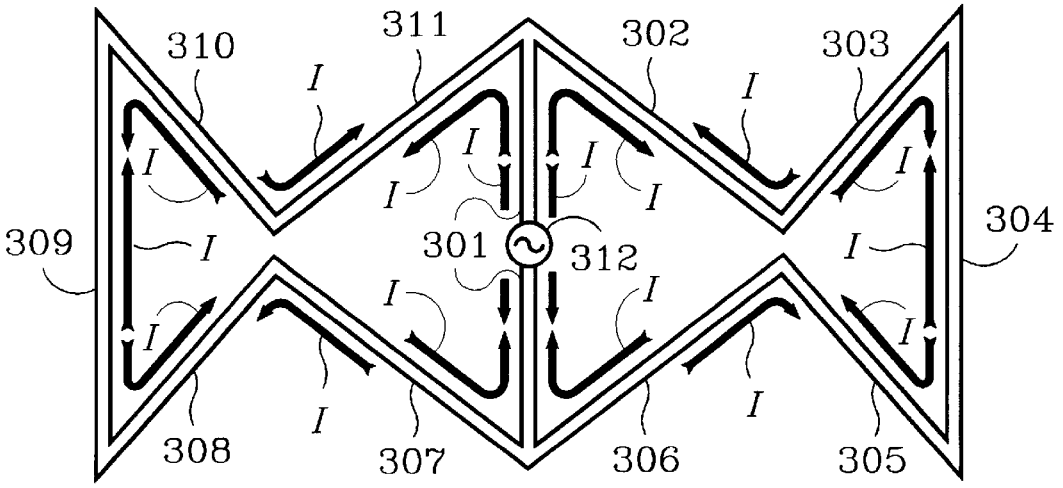
Fig. 3

EXPANDED QUADRUPLE-DELTA ANTENNA STRUCTURE

FIELD OF THE INVENTION

This invention relates to antenna structures, specifically antenna structures that are sets of conducting loops. This is the U.S. version of Canadian patent application 2,179,331. Such antenna structures can be used alone or in combinations to serve many antenna needs. One object of the invention is to achieve a superior transmitting and receiving ability, the gain, in some desired direction. Particularly, an object is to enhance that ability at elevation angles close to the horizon. Another object is to decrease the transmitting and receiving ability in undesired directions. Yet another object is to produce antennas that operate satisfactorily over greater frequency ranges.

Previous disclosures have shown that loops of conductors approximately one wavelength in perimeter yield advantages over more traditional straight conductors approximately one-half wavelength long. Particularly, these loops produce more gain over wider frequency ranges. Since the 1950's, it has been disclosed that pairs of such loops, particularly triangular loops, produce even more gain and reduce radiation in undesired directions even more. Following this line of thought, a more recent disclosure showed that sets of four such triangular loops produce even better performance. That prior art raises the question of whether loops having other perimeters have merit. This disclosure presents the merit of antenna structures having sets of four triangular loops that have perimeters larger than one wavelength. Those sets of four triangular loops hereinafter will be called expanded quadruple-delta antenna structures.

LIST OF DRAWINGS

The background of the invention as well as the objects and advantages of the invention will be apparent from the following description and appended drawings, wherein:

FIG. 2 illustrates the principal planes passing through antennas;

FIG. 3 illustrates the front view of the basic expanded quadruple-delta antenna structure of this disclosure;

PRIOR ART-SINGLE LOOPS

There have been many antennas proposed in the literature based on loops approximately one wavelength in perimeter, but there seems to be less discussion of the reasons why some structures are better than other ones. In order to understand the present disclosure, it is important to review and evaluate those previous structures. The following discussion will deal with the merit of one-wavelength loops, pairs of loops, pairs of triangular loops, and sets of four triangular loops. Then it will be possible to show the merit of triangular loops having perimeters larger than one wavelength.

The classical elementary antenna structure, called a half-wave dipole, is a straight conductor approximately one-half wavelength long. One of its disadvantages is that it transmits or receives equally well in all directions perpendicular to the conductor. That is, in the transmitting case, it does not have much gain because it wastes its ability to transmit in desired directions by sending signals in undesired directions. Another disadvantage is that it occupies a considerable space from end to end, considering that its gain is low. A third disadvantage is that it is susceptible to noise caused by precipitation. Yet another disadvantage is that if a high transmitter power were applied to it, in some climatic conditions, the very high voltages at the ends of the conductor could ionize the surrounding air and produce corona discharges. These discharges can remove material from the conductor ends and, therefore, progressively shorten the conductors.

A worthwhile improvement has been achieved by using loops of various shapes that are one-wavelength in perimeter. Some examples are in the U.S. Pat. Nos. 2,537,191 of Clarence C. Moore, 3,268,899 of J. D. Walden, and Des. 213,375 of Harry R. Habig. Mathematical analysis shows that circular loops are the best of the common shapes and the triangles are the worst. However, the differences are small.

Figure 4:
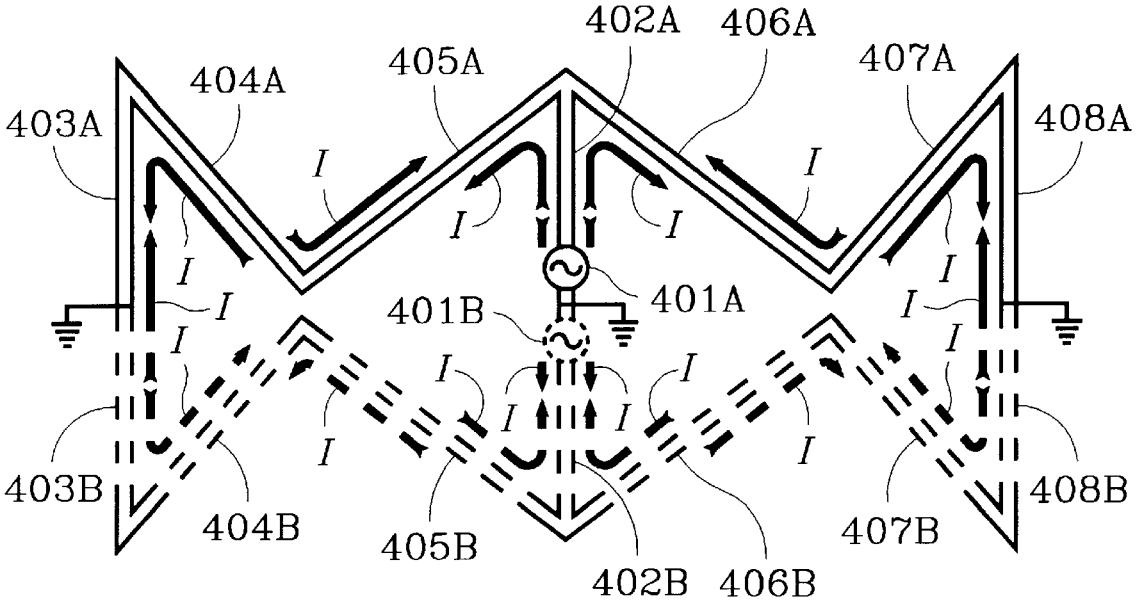
FIG. 4 illustrates the front view of one-half of an expanded quadruple-delta antenna structure mounted on the ground.

Although the other advantages of these loops are important, the gain advantage is most significant to this discussion. To illustrate this advantage, FIG. 2 shows the rectangular version of them (201). The wide arrows in this diagram, as well as in FIGS. 3 and 4, represent some aspects of the currents flowing in the conductors. All of these arrows attempt to denote the current patterns as the standing waves vary from each null through the maximum to the following null in each electrical half-wave of the current paths. At the centers of these arrows, the currents would reach the maxima for the paths denoted by these particular arrows. Where the arrowheads or arrow tails face each other, there would be current nulls and the currents immediately on either side of these points would be flowing in opposite directions. However, beside these indications of where the current maxima and minima would be located, not much else is denoted by these arrows. Particularly, one should not assume that the currents at the centers of all the current paths are of the same magnitude and phase as each other even though all of these currents are denoted as I. In general, the interaction of the currents will produce a complicated amplitude and phase relationship between these currents. Nevertheless, it would be unusual if the phase of these currents were more than 90 degrees away from the phase implied by the direction of the arrows. That is, the phase would not be so different from an implied zero degrees that the arrows should be pointed in the opposite direction because the phase is closer to 180 degrees than to zero degrees.

Of course, these current directions are just the directions of particular currents relative to the directions of other currents. They obviously are all alternating currents which change directions according to the frequency of operation.

Figure 1A:
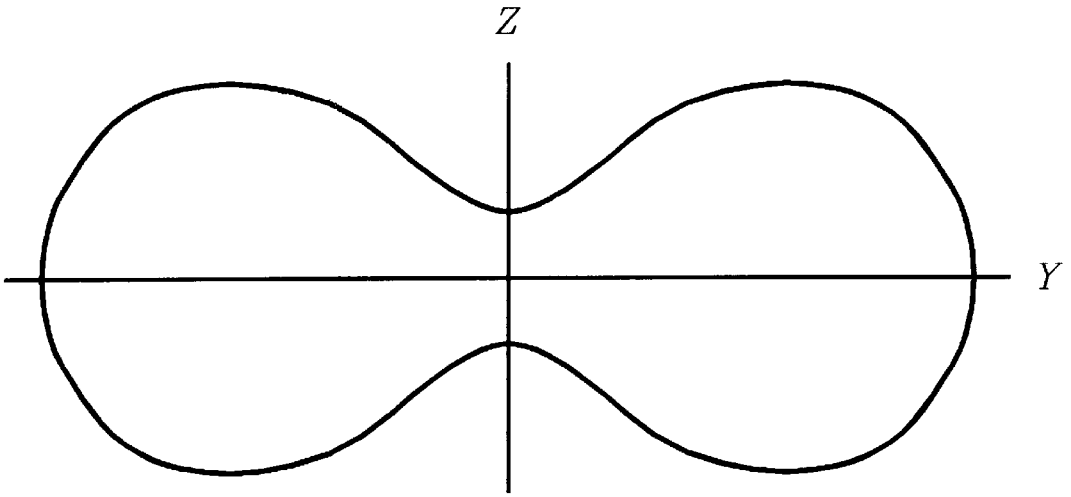
Prior Art Fig. 1A
FIGS. 1A, 1B and 1C illustrate some possible simplified radiation patterns of antennas.

As indicated by the generator symbol (205) in FIG. 2, if energy were fed into one side of the loop, maxima of current standing waves would be produced at this feeding point and at the center of the opposite side of the loop, because it is a one-wavelength loop. The current minima and voltage maxima are half-way between these current maxima. One result of this current distribution is that the radiation is not uniform in the YZ plane (203). This is because there are two conductors carrying the maximum current, the top and bottom of the loop in FIG. 2, which are perpendicular to that plane. Although these two currents are approximately equal in amplitude and phase, because of the symmetry, their fields would add in phase only in the direction of the Y axis. Because the distances from those two conductors to any point on the Y axis are the same, the propagation delays are the same. In other directions, the distances travelled to any point would be different for the two fields, hence the fields would not add in phase. The result is that the radiation pattern in that plane is similar in shape to that illustrated by FIG. 1A. Hereinafter, this plane (203) will be called the principal H (magnetic field) plane, as is conventional.

Figure 1B:
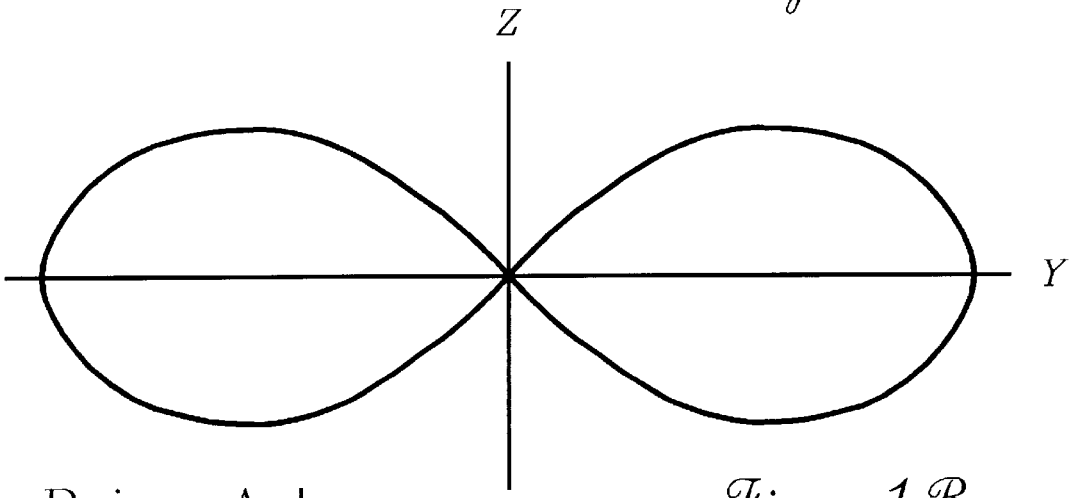
Prior Art Fig. 1B
Figure 1C:
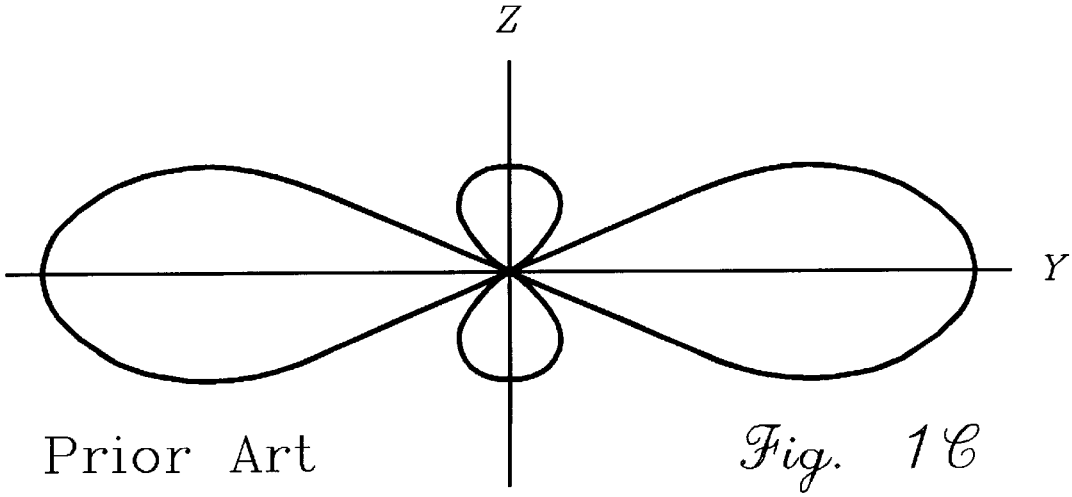
Prior Art Fig. 1C

Therefore, this structure has gain relative to a half-wave dipole antenna in the direction through the axis of the loop, which is the Y axis of FIGS. 1 and 2. Also because of this nonuniform pattern, if plane 203 were vertical (horizontal polarization), signals transmitted at vertical angles near the horizon would be somewhat stronger. This factor gave this antenna structure the reputation for being better when a high supporting tower is not available. Antennas located near the ground usually produce weak signals near the horizon.

This ability to produce stronger signals near the horizon is important in and above the very-high frequencies because signals generally arrive at low vertical angles. Fortunately, it is not difficult to put signals near the horizon at such frequencies because it is the height in terms of wavelengths that matters and, with such short wavelengths, antennas easily can be positioned several wavelengths above the ground. It also is important to put signals near the horizon at high frequencies because long-distance signals arrive at angles near the horizon and they usually are the weaker signals. This is more difficult to achieve, because the longer wavelengths determine that antennas usually are close to the ground in terms of wavelengths.

Another advantage of this kind of structure is that it is only one-half as wide as the half-wave dipole antenna and, therefore, it can be placed in smaller spaces. On the other hand, because its high-current paths are shorter than those of a half-wave dipole, it produces a slightly broader radiation pattern in the plane that is perpendicular to both the plane of the antenna (202) and the principal H plane (203). Hereinafter in this specification and the attached claims, this plane will be called the principal E (electric field) plane (204), as is conventional. This broader pattern reduces the antenna gain to a relatively small extent. The net effect is that these loops do not have as much an advantage in satellite applications, where sheer gain may be most important, as they have in terrestrial applications, where performance at low elevation angles may be most important.

PRIOR ART-PAIRS OF LOOPS

More significant advances have been made using closely spaced pairs of loops. Examples of them have been disclosed by B. Sykes in *The Short Wave Magazine* of January, 1955, by D. H. Wells in U.S. Pat. No. 3,434,145, and by W. W. Davey in 73 *Magazine* of April, 1979. But mathematical analysis reveals that the best combination so far is John Pegler's pair of triangular loops, with one corner of each loop at the central point, which was disclosed by Patrick Hawker in *Radio Communications* of June, 1969. Mr. Hawker reported that Mr. Pegler had used Yagi-Uda arrays of such structures for "some years" on amateur radio and broadcast television frequencies. Because Mr. Pegler called it a "double delta" antenna structure, hereinafter that name will be used.

Because of the interaction of the fields, these combinations of two loops modify the magnitude and phase of the currents to an extent that makes the combination more than just the sum of two loops. The result is that the dimensions can be chosen so that the field patterns in the principal H plane can be like FIG. 1B or even like FIG. 1C. Such dimensions not only give more gain by narrowing the major lobe of radiation but, particularly in the case of FIG. 1B, the radiation in undesired directions also can be greatly reduced. In addition, some arrays of such two-loop combinations can reduce the radiation to the rear to produce very desirable unidirectional radiation patterns in the principal H plane. On the high-frequency bands, such radiation patterns can reduce the strength of high-angle, short-distance signals being received so that low-angle, long-distance signals can be heard. For receiving weak very-high-frequency or ultra-high-frequency signals bounced off the moon, for another example, such a pattern will reduce the noise being received from the earth or from stars that are not near the direction of the moon. Also, for communications using vertical polarization on earth, so that the principal H plane is horizontal, such radiation patterns would reduce the interference from stations located in horizontal directions different from that of the desired station.

The gain advantage of these triangular loops seems to be based on the need to separate the high-current parts of the structure by a relatively large distance. As it is with combinations of Yagi-Uda arrays of dipoles, for example, there is a requirement to space individual antennas by some minimum distance in order to achieve the maximum gain from the combination. The spacing of the high-current parts achieved by the rectangular loops of Sykes and Wells is less than it could be because not only are the outer sides high-current active parts but so also is the central side. Davey's diamonds separate the high-current outer parts to a greater degree, but that shape is not the best available. Triangular loops waste less of the available one-wavelength loop perimeter in placing the outer high-current parts far from the central point. Triangular loops also greatly reduce the radiation from the central high currents because they are flowing in almost opposite directions into and out of the central corner. Therefore, as far as combinations of two loops approximately one wavelength in perimeter are concerned, these triangular shapes seem to produce the maximum gain available so far.

PRIOR ART-FOUR LOOPS

Since this prior art of pairs of triangular loops performs well, it is reasonable to investigate combinations of more triangular loops. Because it is usually desirable to have the maximum gain in the direction perpendicular to the planes of the loops, that requirement would logically restrict the investigation to structures that are symmetrical around the central point of the structure. And since single triangles are not symmetrical, such investigations would logically be restricted to even numbers of triangles, rather than odd numbers of triangles. An example is the combination of four triangular loops in my Canadian patent application 2,175,095, which was called a quadruple-delta antenna structure. That antenna structure had three approximately coplanar parallel conductors with four crossing diagonal conductors connecting each end of the central parallel conductor to the opposite ends of the two outer parallel conductors. That combination provides an increase in directivity in the principal H plane without producing large minor lobes of radiation.

Such combinations work well up to the higher very-high or lower ultra-high frequencies. Above such frequencies, that is above approximately one gigahertz, the size of the loops become small enough to produce mechanical difficulties. That is, as the frequency increases, it is increasingly difficult to accurately produce the tiny parts of the antenna. An additional minor difficulty with the quadruple-delta antenna structure is that the diagonal conductors cross each other but should not touch. This situation requires that either these diagonal conductors are bent or the outer parallel conductors will not be in the same plane as the central parallel conductor. A more serious difficulty is that because the central parallel conductor is short in terms of wavelengths, a conventional T match usually will not be long enough to provide the desired impedance. Some modification, such as extensions to the T parts along the diagonal conductors or extra parallel capacitors at the inner ends of the T parts, may be necessary to obtain a match.

THE PRESENT INVENTION

These difficulties with the prior art lead to the question of whether loops with perimeters larger than one wavelength have merit. In general, loops having perimeters larger than one wavelength can produce more gain than one-wavelength loops, but they also usually produce more radiation in undesired directions. To create an antenna with the advantage of more gain without intolerable undesired radiation, an approach is to plot assumed current distributions around prospective loops to find a promising current pattern. Unfortunately, because of the mutual impedances, this probably will provide only a starting point in the investigation.

One starting point could be loops with perimeters of 1.5 wavelengths in a structure similar to the one in FIG. 3. The main feature of this type of structure, relative to the quadruple-delta antenna structure, is that the diagonal conductors do not cross. That is, the whole structure could be in one plane. Another feature is that the triangles are not closed loops, and some people may object to them being called loops. Perhaps they should be called triangular conducting shapes.

That trial structure has merit, but further investigation revealed that perimeters of approximately two wavelengths for the central loops and approximately 1.75 wavelengths for the outer loops produce a superior antenna structure. Those are the dimensions of the structure of this disclosure, which will now be described in more detail.

In FIG. 3, and in most of the following ones, the parts are numbered according to their functions as the sides of triangles. For example, a single piece of tubing may be used to form parts 310, 311, 302 and 303, but this tube would function as four triangle sides and, therefore, it has been given four part numbers so that these functions can be noted separately. Likewise, parts 305, 306, 307 and 308 could be made from a single piece of tubing. Part 301 may be one conductor or two conductors separated by the feed point, represented by the generator symbol, part 312. But, because part 301 functions as one side of the triangles, it has been given just one part number.

The symbol, 312, represents the effective point at which the associated electronic equipment would be connected to produce a balanced feeding system. Hereinafter in this specification and the attached claims, the associated electronic equipment will be the transmitters, receivers, etc. that are usually connected to antennas.

The structure of FIG. 3 has three parts, 309, 301 and 304, that are approximately parallel to each other. Hereinafter in this specification and the attached claims, they will be called the parallel conductors. Each end of these parallel conductors is connected to the corresponding ends of adjacent parallel conductors by pairs of parts. For example, parts 302 and 303 connect the top end of part 301 to the top end of part 304. Hereinafter in this specification and the attached claims, these connecting parts will be called the diagonal conductors. Note that the diagonal conductors at the top of the diagram do not touch the diagonal conductors at the bottom of the diagram. That is, there is a single current path from part 301 through parts 302 to 306 and back to part 301.

By counting the number of arrows around the triangles, it is apparent that the dimensions are unusual. Since the arrows are usually one-half wavelength long, it is apparent that the outer triangles are somewhat more than three half-wavelengths long. The central triangles are apparently more than four half-wavelengths long, but they are not quite as long as the arrows would indicate. This is because the current path through the center of the central parallel conductor happens to be considerably less than a half wavelength long.

This reveals two conditions that seem strange. Since it might be expected that the parallel conductors would be the main radiating parts, it appears strange that the implied current direction in the center of the central parallel conductor is opposite to the direction of the current in the centers of the outer parallel conductors. One would expect that they should aid each other instead of opposing each other. However, one should remember that these arrows do not necessarily mean that the current in the central parallel conductor is exactly 180 degrees out of phase with the currents in the outer parallel conductors. It also should be realized that the aim is to produce a high ratio of radiation in desired directions to radiation in undesired directions. That does not require that fields from the various parts of the antenna add perfectly in the desired direction.

The other strange condition is that because the current path in the center of the central parallel conductor is considerably less than a half-wavelength long, this antenna structure is not resonant. Since a receiving antenna should present a resonant structure to the desired radiation in order to receive the maximum amount of signal and since transmitters usually require resistive load impedances to deliver the rated amount of power, it is often thought that antennas should be resonant. However, the requirement is only that the whole antenna system be resonant. There is no need for the various parts of the system, such as the antenna itself, to be resonant. That is, the requirement would be satisfied if a nonresonant antenna were tuned to resonance. As long as the tuning can be done efficiently, there is no need for the antenna to be resonant.

Strange though it may appear, this antenna structure does perform well. Although the radiation in undesired directions is larger than the undesired radiation from a quadruple-delta antenna structure, it is still much smaller than the radiation in the desired direction. The more important fact is that the radiation in the desired direction, perpendicular to the plane of the structure, is greater than the radiation from a quadruple-delta antenna structure. That is, this antenna structure has more gain.

The choice of the dimensions for such a structure depends on the particular antenna needs. Sometimes the maximum gain is necessary; sometimes the minimum radiation in undesired directions is more important. However, some guidance can be obtained from dimensions that have been found satisfactory in some cases. For example, one might start with the following dimensions for a single expanded quadruple-delta antenna structure that was designed for a minimum of radiation in undesired directions. That design had a central parallel conductor 0.81 free-space wavelengths long and outer parallel conductors 0.74 free-space wavelengths long. The distance between the parallel conductors was 0.82 free-space wavelengths and the perpendicular distance from the central parallel conductor to the place where the diagonal conductors almost meet was 0.48 free-space wavelengths. Of course, the actual design frequency and the cross-sectional dimensions of the conductors would influence these lengths. If a high gain alone were important, the parallel conductors would be made shorter and the spacing between them would be greater. If a wide bandwidth were important, the parallel conductors would be made longer and the spacing between them would be smaller.

Although this antenna structure has advantages, it also has limitations. First, since this structure does not have current loops that are an even number of half wavelengths long, it does not seem appropriate for double-loop designs, as in Moore's patent. That is, in order to have two such structures side-by-side and linked so that the current path goes around the loops twice, it is expected that the loops would be an even number of half-wavelengths long. Otherwise, the currents in adjacent parts of the two loops would not be aiding each other. Secondly, although this structure has a relatively wide bandwidth near the center frequency, its impedance changes considerably far from the center frequency. Therefore, this structure is good for relatively narrow-band applications, but it would be less useful for very-wide-band applications.

HALF EXPANDED QUADRUPLE-DELTA VERSION

On the other hand, the fact that the diagonal conductors do not cross makes convenient versions that are inconvenient with regular quadruple-delta antenna structures. For example, FIG. 4 shows one-half of an expanded quadruple-delta antenna structure mounted on the ground, which hereinafter will be called a half expanded quadruple-delta antenna structure. That is, parts 401A to 408A are real, and parts 401B to 408B are fictitious image parts representing the effect of reflections off the ground. This is similar to the half double-delta antenna structure which John Belrose disclosed in *QST* of April, 1983. As is usual with such image analysis, the currents in horizontal images travel in directions opposite to the currents in their corresponding real parts. On the other hand, the currents in vertical images travel in the same direction as the currents in their corresponding real parts. This produces a current pattern in the combined real and image parts of the structure of FIG. 4 that is similar to the pattern in the real expanded quadruple-delta antenna structure of FIG. 3. Because the regular quadruple-delta antenna structure has crossing diagonal conductors, an equivalent ground mounted structure would need something like a phase-reversing stub where the diagonal conductors approach the ground so that the whole real and image current pattern could be similar to a real quadruple-delta antenna structure.

Since this antenna structure depends on the reflections from the ground for proper operation, it is apparent that good ground conductivity or radials are needed. Note that not only is a "ground plane" needed, as it is for other ground-mounted antennas, but the ground also is the return path for currents travelling between the central parallel conductor and the outer parallel conductors. Therefore, it would seem prudent to have some radial conductors connecting the grounded ends of the three parallel conductors.

CONSTRUCTION TACTICS

Figure 5:
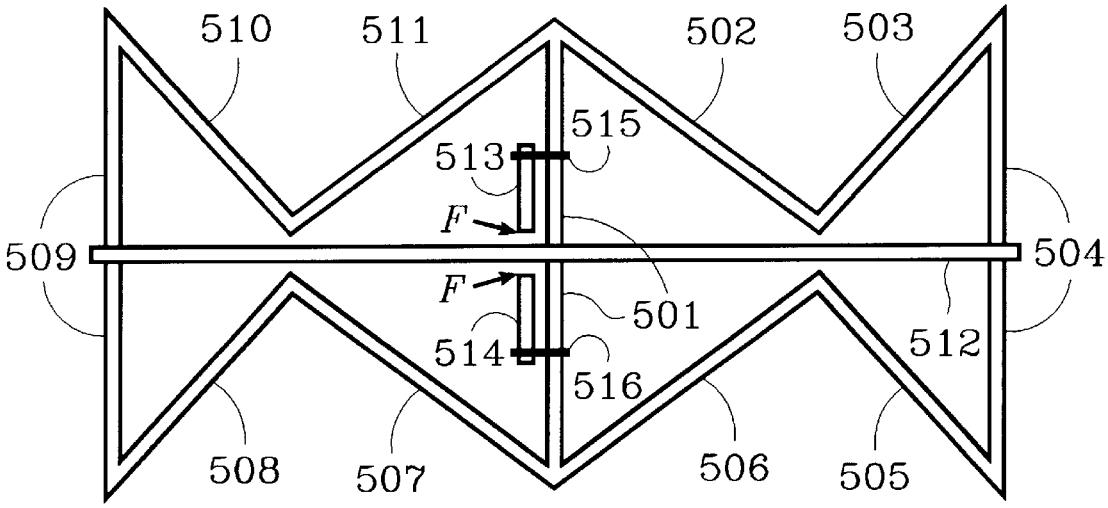
FIG. 5 illustrates the front view of an expanded quadruple-delta antenna structure with a supporting central part and T matching parts.
Figure 6:
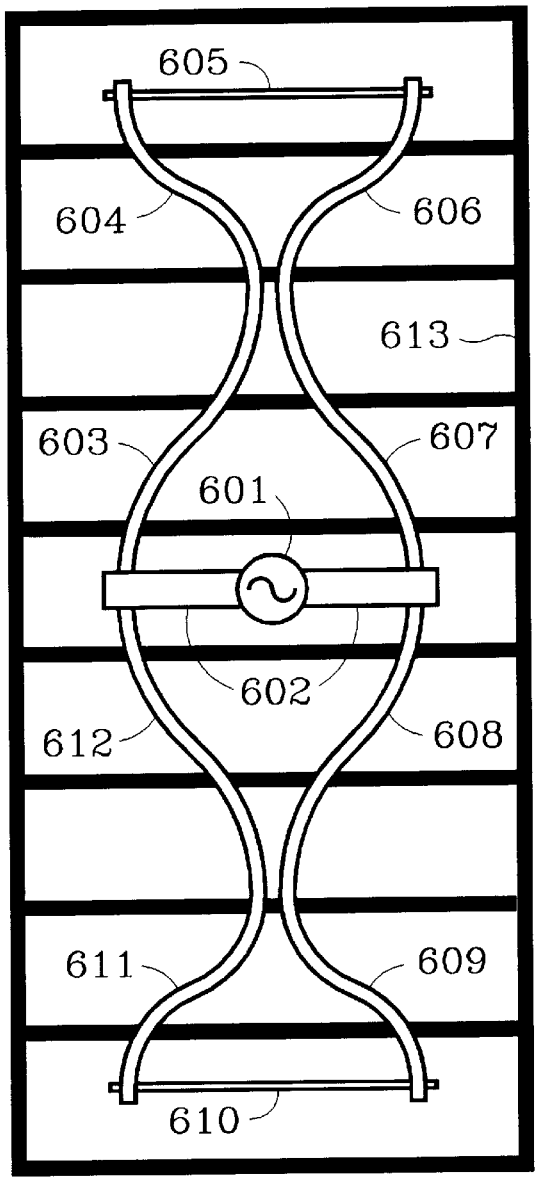
FIG. 6 illustrates the front view of an expanded quadruple-delta antenna structure in front of a reflecting screen that illustrates some more construction tactics.

FIGS. 5 and 6 show some possible construction tactics for these antenna structures. The T matching parts, 513 and 514, and the short circuits, 515 and 516, are quite conventional for matching, in effect, to the center of the central parallel conductor of the structure having parts 501 to 511. One would expect to tune them with capacitors and to apply a balanced to unbalanced transformer if coaxial cable were used. It might not be expected that the T parts, 513 and 514, probably will be rather short. Because the central current path of the central parallel conductor is considerably less than a half wavelength long, the T parts need not be long to reach the high-impedance places.

FIG. 5 shows the T parts disposed to the left of the central parallel conductor only because the connection is depicted more clearly that way. Actually, it is preferable to have the T parts in front of or behind the central parallel conductor. That orientation is desirable so that the two sides of the structure will be equally energized.

It is, of course, good engineering practice to make the connection to a balanced antenna in a balanced manner. Otherwise, the pattern is distorted and the supporting structure will not be at ground potential. This is perhaps not a matter of extreme importance for antennas using half-wave dipoles. Double-delta, quadruple-delta, and expanded quadruple-delta antenna structures, on the other hand, depend on the balance between the currents in various parts to produce their superior radiation patterns. Therefore, the balanced T match is much more appropriate for them than the unbalanced gamma match. On the other hand, the gamma match would be appropriate for the half expanded quadruple-delta antenna structure of FIG. 4. That structure is unbalanced because it is mounted on the ground, so it should have an unbalanced connection system.

If the expanded quadruple-delta antenna structure were connected in a balanced manner, the center of the central parallel conductor would be at ground potential. Also, since the two paths from the center of the central parallel conductor to the center of either outer parallel conductor are equal in length, the centers of the outer parallel conductors also must be at ground potential. Therefore, if a conductor like part 512 connects the centers of the three parallel conductors, no significant current will flow in it from that connection. As FIG. 3 shows, the currents in the parts surrounding it also would ideally have no radiation effect on the currents in part 512. Each current on one side of this part has a corresponding current on the other side to cancel its effect on part 512. Therefore, part 512 would have no significant effect on the operation of the antenna structure.

If the antenna structure were large, it would be very useful to have a part 512 to support the rest of the structure. If the structure were small, it is unlikely that this extra part would be used. Hereinafter, part 512 will be called the central perpendicular conductor.

Turning to other construction matters, the desirable cross-sectional size of antenna conductors depends, of course, upon mechanical as well as electrical considerations. For example, the large structures needed in the high-frequency spectrum probably would have conductors formed by several sizes of tubing. This is because the parts at the end of the structure support only themselves while the parts near the center must support themselves and the parts further out in the structure. This variety of mechanical strengths required would make convenient a variety of conductors. For example, in FIG. 6, the outer parallel conductors, 605 and 610, have smaller diameters than the central parallel conductor, 602, with its generator symbol, 601. The remaining diagonal conductors, 603, 604, 606 to 609, 611, and 612, have diameter sizes between the sizes of these parallel conductors. At ultra-high frequencies, on the other hand, it may be convenient to construct these antennas using a single size of tubing, because only a small cross-sectional area may be needed anywhere in such small structures.

Although the triangular shape serves the purpose of allowing the parallel conductors to be separated farther than is possible with other shapes, it is not necessary that the shape be strictly triangular. The curved "hour glass" shape of FIG. 6, for example, could be convenient because this shape places the joining conductors at right angles to each other. If holes must be drilled or if clamps must be made, it is often convenient to have a 90-degree angle between the conductors. This aim of having the conductors meet at right angles also could be met by having the diagonal conductors bent only near the places where the conductors meet. However, this tactic would forego another advantage of the continuously curved shape. Those curves seem to be more pleasing to some people than straight lines.

At very-high frequencies, bending the small tubing probably would be the chosen method of using this idea. At lower frequencies, where the tubing would be large in diameter, dividing the conductors into small pieces with special couplings between the pieces to achieve such a shape may be the preferable method of construction.

There are many conventional and acceptable means of connecting the various parts of expanded quadruple-delta antenna structures. For example, they could be clamped, bolted, soldered, brazed or welded with or without pipe fittings at the joints. As long as the effect of the means of connection upon the effective length of the parts is taken into account, there seems to be no conventional means of connecting antenna parts that would not be acceptable for expanded quadruple-delta antenna structures. However, before the final dimensions have been obtained, it is convenient to use clamps that allow adjustments to the length of the parallel conductors. Often a computer-aided design will produce reasonably correct distances between the parallel conductors and between the various expanded quadruple-delta antenna structures in an array, so that it will be necessary to adjust only the lengths of the parallel conductors on the antenna range to produce an acceptable final design.

APPLICATION-TURNSTILE ARRAYS

Figure 7:
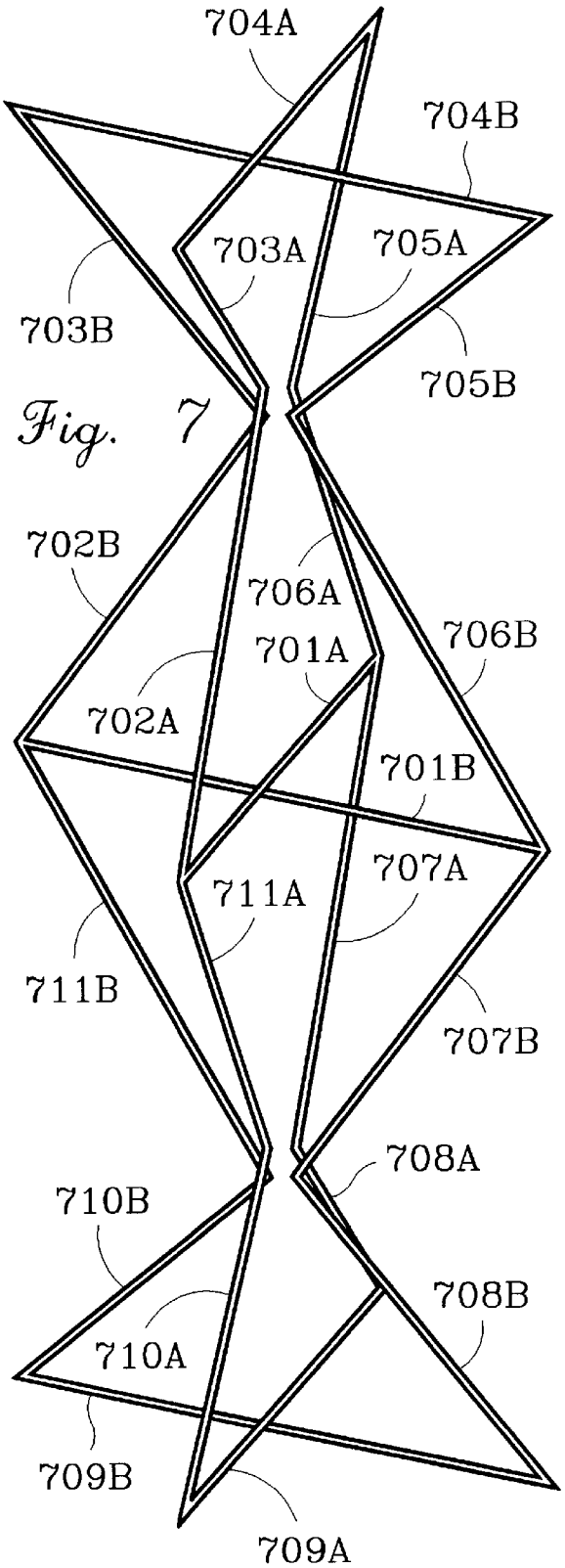
FIG. 7 illustrates a perspective view of a turnstile array of two expanded quadruple-delta antenna structures.

These basic antenna structures can usually be used in many of the ways that half-wave dipole antennas are used. That is, combinations of them of particular sizes can be used to produce better antennas. For television broadcasting or for networks of stations, a horizontally-polarized radiation pattern is often needed that is omnidirectional in the horizontal plane, instead of unidirectional. To achieve this, an old array called a turnstile antenna sometimes has been used. It has two half-wave dipole antennas oriented at right angles to each other and fed 90 degrees out of phase with each other. FIG. 7 shows the equivalent arrangement of expanded quadruple-delta antenna structures which would serve the same purpose. The difference is that there would be more gain in the principal H plane, which would usually be the vertical plane. That is, if it were necessary to have several turnstile arrays stacked vertically for increased gain, the equivalent stack of turnstile expanded quadruple-delta antenna structures would require fewer feed points for the same gain. In FIG. 7, the parts 701A to 711A form one expanded quadruple-delta antenna structure and the parts 701B to 711B form the other one. Because the feeding system could be the conventional system for turnstile arrays, it was omitted from this diagram to avoid unnecessary confusion.

Turnstile arrays of half-wave dipoles, double-delta antenna structures, and quadruple-delta antenna structures produce radiation patterns that are almost omnidirectional. That is because the E-plane directivity of these structures is not so high that there are significant peaks in front of the individual structures in the array. The E-plane directivity also is not so low that the combination of the radiation from the two structures produces peaks between the directions in front of the individual structures.

Unfortunately, in this application, the expanded quadruple-delta antenna structure has sufficient directivity in the principal E plane that the resulting radiation pattern may be considered unsatisfactory. That is, there are significant peaks in front of the individual structures. A significant improvement in the pattern can be obtained by using three expanded quadruple-delta antenna structures, instead of two, separated physically and electrically by 60 degrees, instead of 90 degrees.

Of course, a perfectly omnidirectional radiation pattern is not always desired. If coverage were needed more in some directions than in other directions, a modification to the above arrays would be desirable. For example, if the powers applied were unequal or the phase relationships were not 90 degrees or 60 degrees, a radiation pattern more suitable to the particular circumstances might be obtained.

Since a turnstile array probably will be attached to a conducting vertical mast, FIG. 5 suggests that the centers of all the parallel conductors should be attached to it. With the array attached to the mast in three places, a very strong and rigid structure is possible.

APPLICATION-COLLINEAR AND BROADSIDE ARRAYS

Another application of expanded quadruple-delta antenna structures arises from observing that half-wave dipoles traditionally have been positioned in the same plane either end-to-end (collinear array), side-by-side (broadside array), or in a combination of those two arrangements. Often, a second set of such dipoles, called reflectors or directors, is put into a plane parallel to the first one, with the dimensions chosen to produce a somewhat unidirectional pattern of radiation. Sometimes an antenna structure is placed in front of a reflecting screen (613), as in FIG. 6. Such arrays have been used on the high-frequency bands by short-wave broadcast stations, on very-high-frequency bands for television broadcast reception, and by radio amateurs.

Figure 8:
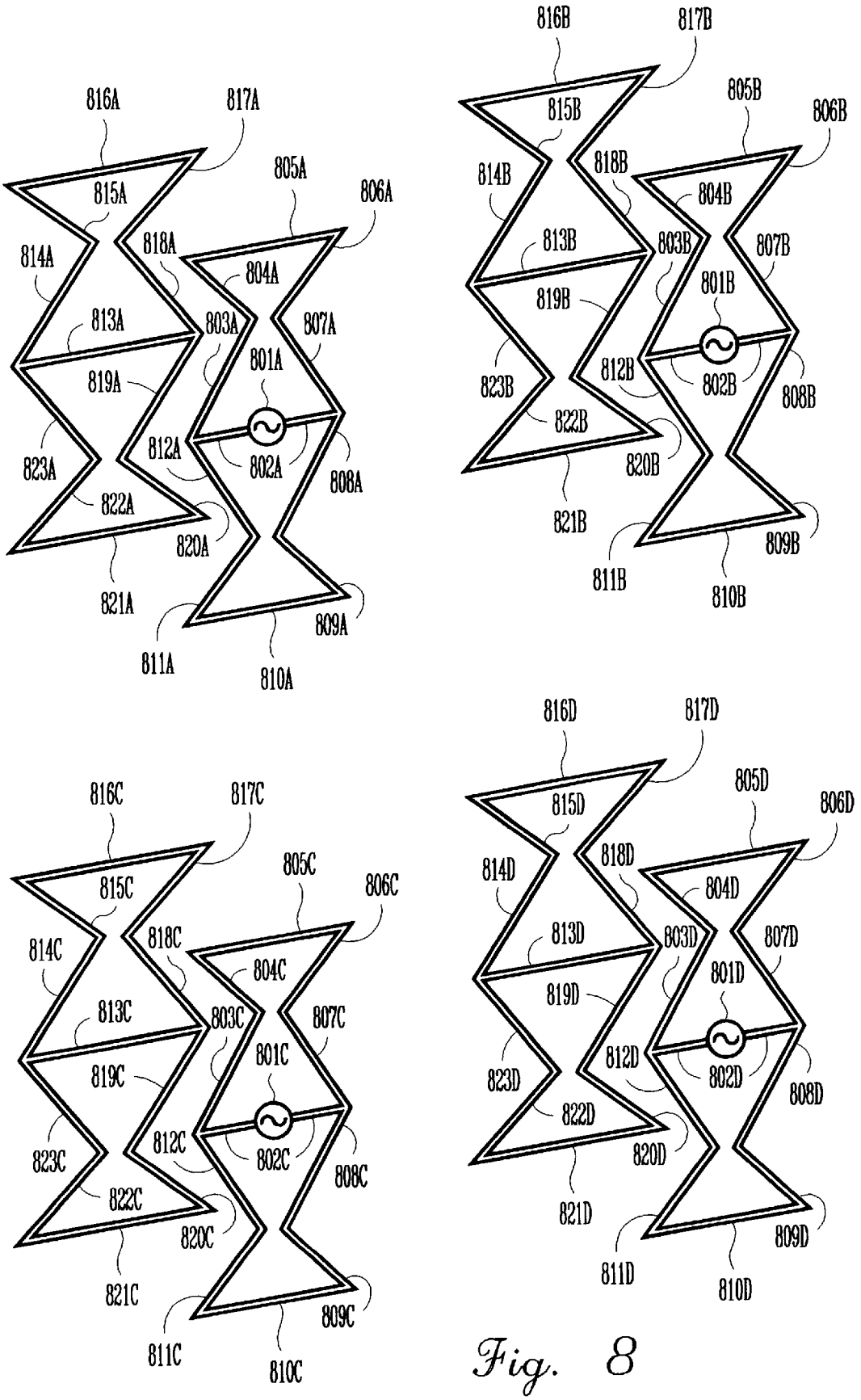
FIG. 8 illustrates a perspective view of four combinations of expanded quadruple-delta antenna structures with similar reflecting structures to illustrate the collinear and broadside arrangements of such antenna structures.

The same tactics can be used with expanded quadruple-delta antenna structures, as FIG. 8 shows. The array with the parts 801A to 823A is in a collinear arrangement with the array with parts 801B to 823B, because their corresponding parallel conductors are aligned in the direction parallel to the parallel conductors. That is, they are positioned end-to-end. The array with parts 801C to 823C and the array with parts 801D to 823D are similarly positioned. The A array is in a broadside arrangement with the C array, because their corresponding parallel conductors are aligned in the direction perpendicular to the parallel conductors. The B array and the D array are similarly positioned.

Perhaps the main advantage of using expanded quadruple-delta antenna structures rather than dipoles in such arrays is the less complicated system of feeding the array for a particular overall array size. That is, each expanded quadruple-delta antenna structure would perform in such an array as well as two or more half-wave dipoles.

Sometimes collinear or broadside arrays of dipoles have used unequal distributions of energy between the dipoles to reduce the radiation in undesired directions. Since expanded quadruple-delta antenna structures reduce such undesired radiation anyway, there would be less need to use unequal energy distributions in equivalent arrays to achieve the same kind of result. Nevertheless, if such an unequal energy distribution were used, it might be less complicated to implement because of the less complicated feeding system.

APPLICATION-NONLINEAR POLARIZATION

Yet another application of expanded quadruple-delta antenna structures concerns nonlinear polarization. In communications via satellites or in communications on earth through the ionosphere, the polarization of the signal may be elliptical. In such cases, it may be advantageous to have both vertically polarized and horizontally polarized antennas. They may be connected together to produce a circularly polarized antenna, or they may be connected separately to the associated electronic equipment for a polarity diversity system. Also, they may be positioned at approximately the same place or they may be separated to produce both polarity diversity and space diversity.

Figure 9:
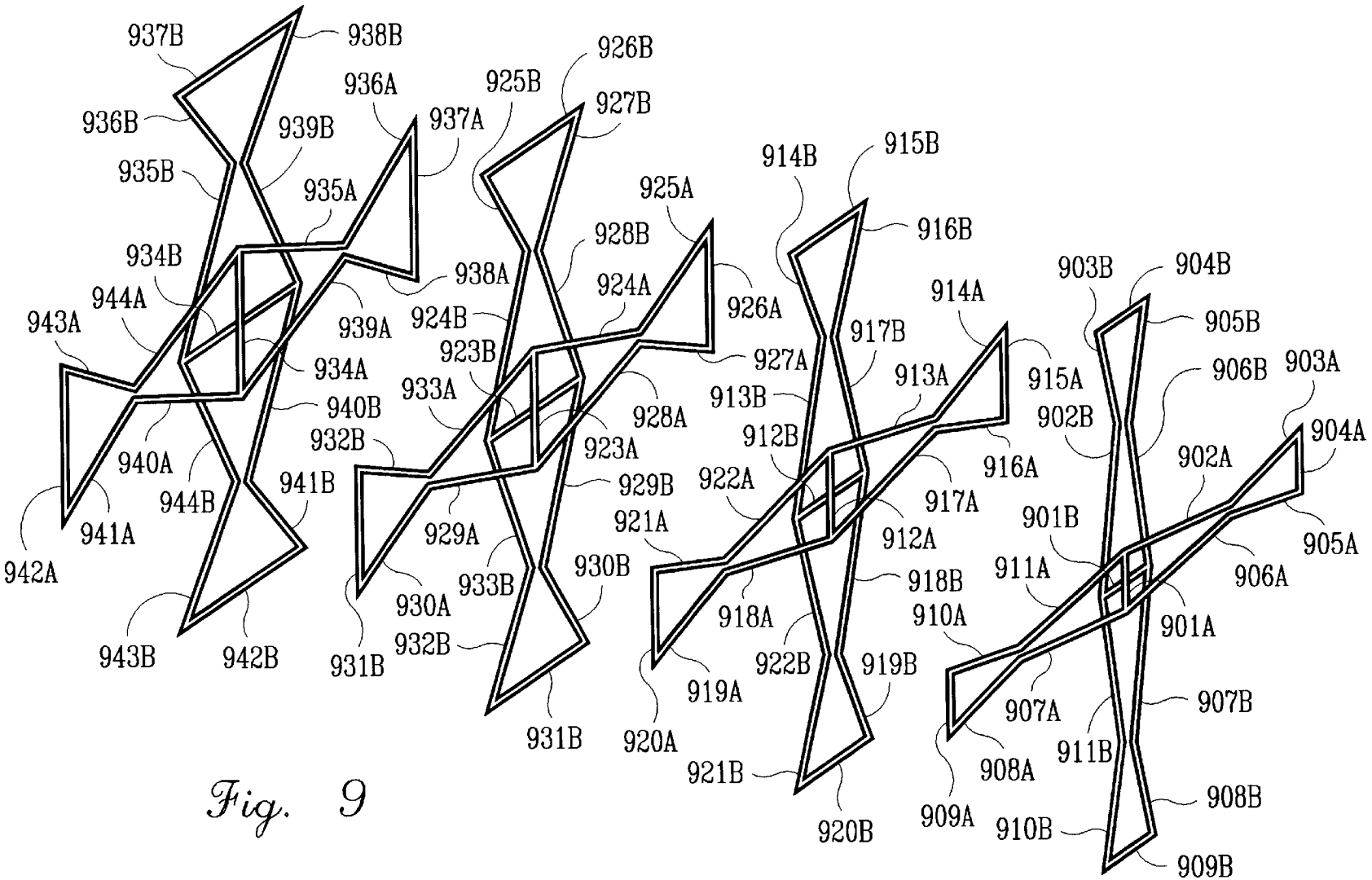
FIG. 9 illustrates a perspective view of the combination of two end-fire arrays of expanded quadruple-delta antenna structures disposed to produce circularly polarized radiation.

FIG. 9 illustrates an array of expanded quadruple-delta antenna structures for achieving this kind of performance. Parts 901A to 944A form a vertically polarized array and parts 901B to 944B form a horizontally polarized array. If the corresponding expanded quadruple-delta antenna structures of the two arrays were approximately at the same positions along the supporting boom, as in FIG. 9, the phase relationship between equivalent parts in the two arrays usually would be about 90 degrees for approximately circular polarization. If the corresponding expanded quadruple-deltas structures of the two arrays were not in the same position on the boom, as is common with similar half-wave dipole arrays, some other phase relationship would be used. This is because the difference in position plus the difference in phase could produce the 90 degrees for circular polarization. It is common with equivalent half-wave dipole arrays to choose the positions on the boom so that the two arrays can be fed in phase and still achieve circular polarization.

However, one should not assume that this choice of position on the boom and phasing does not make a difference. If the two half-wave dipoles were positioned at the same place and were phased by 90 degrees, there would tend to be a maximum of one polarity toward the front and a maximum of the other polarity toward the rear. For example, there may be a maximum of right-hand circularly polarized radiation to the front and a maximum of left-hand circularly polarized radiation to the rear. In the same example, there would be a null, ideally, of left-hand radiation to the front and a null of right-hand radiation to the rear. An equivalent array that produces the phase difference entirely by having the two dipoles in different positions on the boom would perform differently. It would have maxima of right-hand radiation toward the front and toward the rear. The left-hand radiation would have maxima to the side of the array and nulls to the front and rear.

Of course, these are idealized patterns for dipoles and expanded quadruple-delta antenna structures would perform differently. Also, if these structures were put into larger arrays, the patterns would change some more. Nevertheless, one should not assume that the choice of using phasing or positions on the boom does not change the antenna performance. One must make the choice considering what kind of performance is desired for the particular application.

Although this arrangement of structures is usually chosen to produce circularly polarized radiation, one also should note that a phase difference of zero degrees or 180 degrees will produce linear polarization. As the array is shown in FIG. 9, those linear polarizations would be at 45-degree angles to the earth, which probably would not be desired. It probably would be more desirable to rotate the array around the axes of the triangles by 45 degrees to produce vertical and horizontal polarization. With such an array, it would be possible to choose vertical polarization, horizontal polarization, or either of the two circular polarizations by switching the amount of phase difference applied to the system. Such a system may be very useful for radio amateurs who use vertical polarization for frequency modulation, horizontal polarization for single sideband or Morse code, and circular polarization for satellite communication on very-high and ultra-high frequencies. On high frequencies, such a choice of polarization would be convenient because received signals from the ionosphere have various polarizations.

APPLICATION-YAGI-UDA ARRAYS

Figure 10:
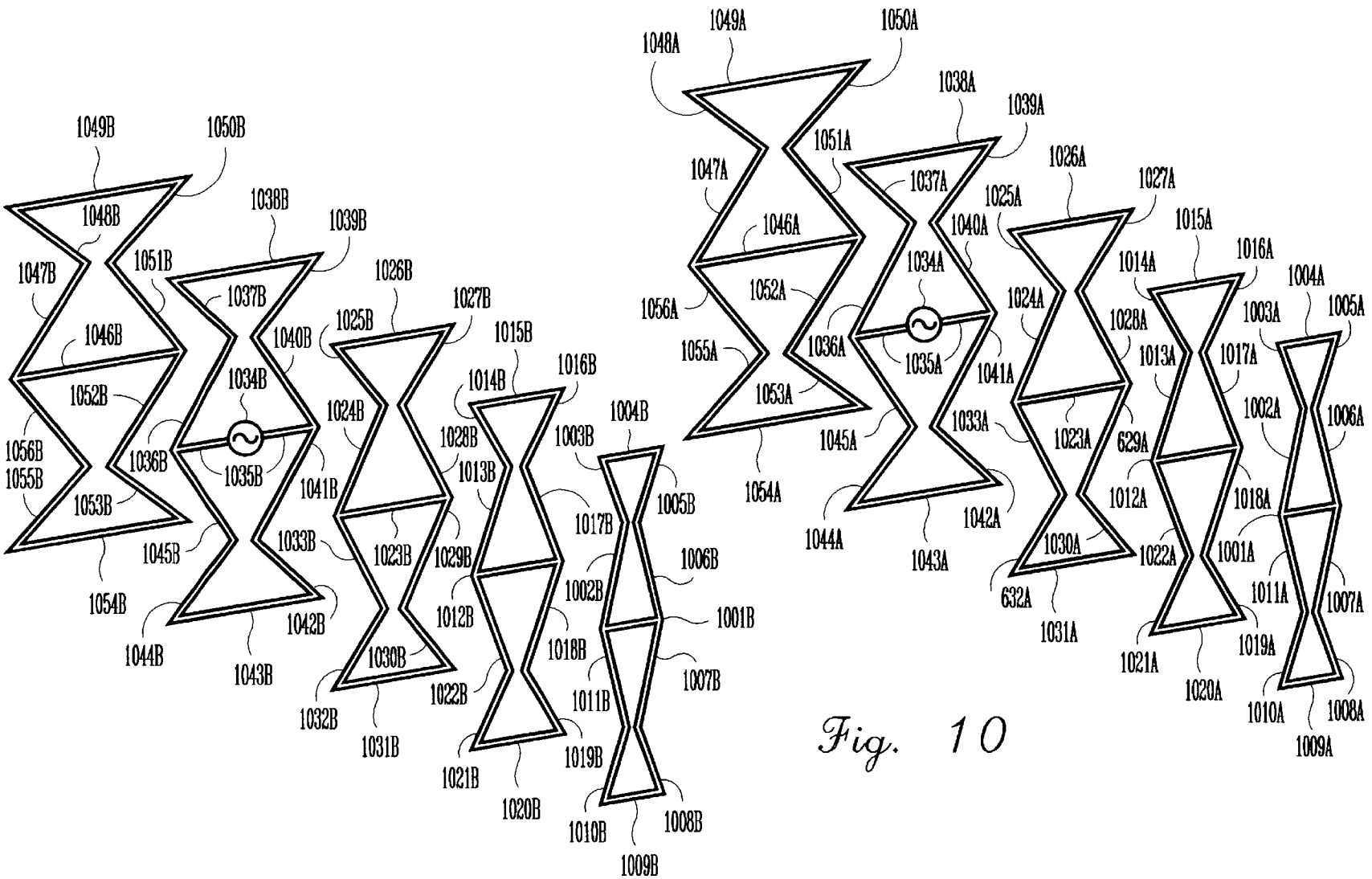
FIG. 10 illustrates a perspective view of two Yagi-Uda arrays of expanded quadruple-delta antenna structures pointing in the same direction.

Yet another application, commonly called an end-fire array, would have several expanded quadruple-delta antenna structures positioned so that they are in parallel planes, so that the parallel conductors in each structure are parallel to the parallel conductors in the other structures, and so that the centers of the parallel conductors are aligned perpendicular to the planes. One expanded quadruple-delta antenna structure, some of them, or all of them could be connected to the associated electronic equipment. If the second expanded quadruple-delta antenna structure from the rear were so connected, as in FIG. 10, and the dimensions produced the best performance toward the front, it could logically be called a Yagi-Uda array of expanded quadruple-delta antenna structures. Hereinafter, that name will be used for such structures. FIG. 10 illustrates two such Yagi-Uda arrays in a collinear arrangement; parts 1001A to 1056A forming one of them and parts 1001B to 1056B forming the other one. Hereinafter, the expanded quadruple-delta antenna structures having generator symbols, 1034A and 1034B, will be called the driven structures. The structures to the rear with parts 1046A to 1056A and parts 1046B to 1056B will be called the reflector structures. The remaining structures will be called the director structures. This terminology is conventional with the traditional names for dipoles in Yagi-Uda arrays. Another less popular possible array would be to have just two such structures with the rear one connected, called the driven structure, and the front one not connected, called the director structure.

The tactic for designing a Yagi-Uda array is to employ empirical methods rather than equations. This is partly because there are many combinations of dimensions that would be satisfactory for a particular application. Fortunately, there are computer programs available that can refine designs if reasonable trial designs are presented to the programs. That is as true of expanded quadruple-delta arrays as it is for dipole arrays. To provide a trial design, it is common to make the driven structure resonant near the operating frequency, the reflector structure resonant at a lower frequency, and the director structures resonant at progressively higher frequencies from the rear to the front. Then the computer program can find the best dimensions near to the trial dimensions.

The use of expanded quadruple-delta antenna structures instead of dipoles in such an array differs in two respects. Since the radiation pattern in the principal H plane can be changed, that is something to choose. A pattern like that of FIG. 1B may be chosen to suppress the radiation in undesired directions. The second factor is that in arrays that have expanded quadruple-delta antenna structures aligned from the front to the rear, one should remember that the principal radiating parts, the parallel conductors, should preferably be aligned to point in the direction of the desired radiation, perpendicular to the planes of the individual structures. That is somewhat important in order to achieve the maximum gain, but it is more important in order to suppress the radiation in undesired directions. Therefore, when the resonant frequencies of the structures must be unequal, the distances between the parallel conductors should all be approximately equal and the lengths of the parallel conductors should be chosen to produce the desired resonant frequencies. FIG. 10 shows this. That is, the distances between the parallel conductors should preferably be chosen to get the desired pattern in the principal H plane, and the lengths of the parallel conductors should be changed to achieve the other goals, such as the desired gain.

APPLICATION-ALL-DRIVEN ARRAYS

There are several possibilities for all-driven end-fire arrays but, in general, the mutual impedances make such designs rather challenging and the bandwidth can be very small. A small, feasible all-driven array would be just two substantially identical expanded quadruple-delta antenna structures which are fed 180 degrees out of phase with each other. The space between the structures would not be critical, but one-eighth of a wavelength would be a reasonable value. This would be similar to the dipole array disclosed by John D. Kraus in *Radio* of March, 1937, which is commonly called a W8JK array, after his amateur-radio call letters. Since the impedances of the two structures are equal when the phase difference is 180 degrees, it is relatively easy to achieve an acceptable bidirectional antenna by applying such tactics. If a balanced transmission line is used, the conductors going to one structure are simply transposed. For coaxial cable, an extra electrical half wavelength of cable going to one structure might be a better device to provide the desired phase reversal. If the space were available, such a fixed bidirectional array of expanded quadruple-delta antenna structures could be very desirable in the lower part of the high-frequency spectrum where rotating antennas may not be practicable because they are very large.

Another possibility is two structures spaced and connected so that the radiation in one direction is almost canceled. An apparent possibility is a spacing between the structures of a quarter wavelength and a 90-degree phase difference in their connection. Other space differences and phase differences to achieve unidirectional radiation will produce more or less gain, as they will with half-wave dipoles.

APPLICATION-LARGE ARRAYS

End-fire arrays of expanded quadruple-delta antennas can be used in the ways that such arrays of half-wave dipoles are used. For example, FIG. 9 shows two end-fire arrays that are disposed to produce circularly polarized radiation. For another example, FIG. 10 shows two Yagi-Uda arrays disposed so that corresponding expanded quadruple-delta antenna structures of the two arrays are in the same vertical planes. In this case, the orientation positions the parallel conductors of one array end-to-end, collinear, with the equivalent parts of the other array. The arrays also could be positioned one above the other, broadside, or several arrays could be arranged in both orientations.

Since the gain of such large arrays tends to depend on the overall area of the array facing the direction of maximum radiation, it is unrealistic to expect much of a gain advantage from using expanded quadruple-delta antenna structures in large arrays of a particular overall size. However, since the individual arrays in the overall array could have more gain if they were composed of expanded quadruple-delta antenna structures, the feeding system could be simpler because fewer individual structures would be needed to fill the overall space adequately. In addition, the superior ability of the expanded quadruple-delta antenna structures to suppress received signals arriving from undesired directions is a considerable advantage when the desired signals are small. For communication by reflecting signals off the moon, the ability to suppress undesired signals and noise is a great advantage.

It is well known that there is some minimum spacing between the individual antenna structures in collinear or broadside arrays so that the gain of the whole structure will be maximized. If the beam widths of the individual structures were narrow, that minimum spacing would be larger than if the beam width were wide. In other words, if the gain of the individual structures were large, the spacing between them would be large. Large spacing, of course, increases the cost and weight of the supporting structure.

Because the half-wave dipole has no directivity in the principal H plane, Yagi-Uda arrays of half-wave dipoles usually have wider beam widths in the principal H plane than in the principal E plane. Therefore, the spacing necessary to obtain the maximum gain from two such arrays would be less for a broadside array than for a collinear array. That is, for a horizontally polarized array, it would be better from a cost and weight point of view to place the two arrays above each other rather than beside each other. The double-delta, quadruple-delta, and expanded quadruple-delta antenna structures present the opposite situation. Because the latter structures produce considerable directivity in the principal H plane, a Yagi-Uda array of them would have a narrower beam in the principal H plane than in the principal E plane. Therefore, it would be better to place two such arrays side by side, as in FIG. 10, rather than one above the other. Of course, mechanical or other considerations may make other choices preferable. For example, it is usually better to mount a horizontally polarized antenna on a vertical support structure to minimize the effect of the supporting structure on the antenna. The side-by-side arrangement would involve a horizontal support for a horizontally polarized antenna.

It is also unrealistic to expect that long Yagi-Uda arrays of expanded quadruple-delta antennas structures will have a large gain advantage over long Yagi-Uda arrays of half-wave dipoles. The principle of a minimum necessary spacing applies here as well. It is not exactly true, but one can consider that the double-delta, quadruple-delta, and expanded quadruple-delta antenna structures are dipoles, represented by the parallel conductors, joined by the diagonal conductors. Presented in that manner, a Yagi-Uda array of double-delta antenna structures could be considered equivalent to a broadside array of two Yagi-Uda arrays of dipoles. Likewise, a Yagi-Uda array of quadruple-delta or expanded quadruple-delta antenna structures could be regarded as three Yagi-Uda arrays of dipoles, because these structures have three parallel conductors.

Each of these three Yagi-Uda arrays have some beam width in the principal H plane and, therefore, they should be separated by some minimum distance to produce the maximum gain for the combination. The longer the Yagi-Uda array is, of course, the narrower the individual H-plane beams would be and the greater the spacing should be. That is, since the spacing is limited by the need to have triangular structures of a particular size, a long Yagi-Uda array of double-delta, quadruple-delta, or expanded quadruple-delta antenna structures would not have as much gain as one might expect.

Also, it should be noted that there is usually an advantage to making Yagi-Uda arrays of at least four double-delta antennas structures because four elements are usually required to produce an excellent suppression of the radiation to the rear of the array. Beyond that array length, the increase in gain for the increase in length probably will be disappointing because the distance between the parallel conductors cannot be increased very much. That is, the usual expectation of twice the gain if the length were doubled will not be realized. It probably will be wiser to employ more than one Yagi-Uda array of double-delta antenna structures in a larger collinear or broadside array or to employ a longer array of quadruple-delta or expanded quadruple-delta antenna structures. The quadruple-delta or expanded quadruple-delta antenna structures are more suited to longer arrays because there is more distance between their outer parallel conductors. However, constructing Yagi-Uda arrays of more than eight or ten of these larger structures also may be disappointing.

CONCLUSION

Except for the restrictions of size, weight, and cost, expanded quadruple-delta antenna structures could be used for almost whatever purposes that antennas are used. Beside the obvious needs to communicate sound, pictures, data, etc., they also could be used for such purposes as radar or for detecting objects near them for security purposes. Since they are much larger than half-wave dipoles, it would be expected that they would generally be used in the very-high and ultra-high frequency ranges. However, they may not be considered to be too large for short-wave broadcasting because that service typically uses very large antennas. If the space were available, arrays of half expanded quadruple-delta antenna structures could be worthwhile in the high-frequency spectrum. One might even use such structures in the medium-frequency spectrum if the needed gain or the suppression of radiation in undesired directions were unavailable from the usual arrays of quarter-wave vertical monopoles.

While this invention has been described in detail, it is not restricted to the exact embodiments shown. These embodiments serve to illustrate some of the possible applications of the invention rather than to define the limitations of the invention.

I claim:

1. An antenna structure, comprising:

(a) three approximately parallel conductors, disposed approximately in a plane, separated from each other by approximately equal distances, and aligned so that their centers are approximately on a line that is approximately perpendicular to said approximately parallel conductors;

(b) two first diagonal conductors, of approximately equal length, connected to the two ends of the proximal approximately parallel conductor, and extended diagonally in said plane toward the first distal approximately parallel conductor, until said first diagonal conductors almost meet each other between said approximately parallel conductors, almost at the line of the centers of said approximately parallel conductors, thereby producing an approximately triangular conductor, comprising said proximal approximately parallel conductor and said first diagonal conductors, which has a perimeter of approximately two wavelengths at the operating frequency;

(c) two second diagonal conductors, of approximately the same length as said first diagonal conductors, also connected to the two ends of said proximal approximately parallel conductor, and extended diagonally in said plane toward the second distal approximately parallel conductor, until said second diagonal conductors almost meet each other between said approximately parallel conductors, almost at the line of the centers of said approximately parallel conductors, thereby producing a second approximately triangular conductor, comprising said proximal approximately parallel conductor and said second diagonal conductors, which has a perimeter of approximately two wavelengths at the operating frequency;

(d) two third diagonal conductors, of approximately equal length, but not necessarily the same length as said first or second diagonal conductors, connected from said first diagonal conductors, at the ends where they almost meet, to the two ends of said first distal approximately parallel conductor, without said third diagonal conductors crossing each other, thereby producing a third approximately triangular conductor, comprising said first distal approximately parallel conductor and said third diagonal conductors, which has a perimeter of approximately one and three-quarters wavelengths at the operating frequency;

(e) two fourth diagonal conductors, of approximately the same length as said third diagonal conductors, connected from said second diagonal conductors, at the ends where they almost meet, to the ends of said second distal approximately parallel conductor, without said fourth diagonal conductors crossing each other, thereby producing a fourth approximately triangular conductor, comprising said second distal approximately parallel conductor and said fourth diagonal conductors, which has a perimeter of approximately one and three-quarters wavelengths at the operating frequency; and (f) means for connecting the associated electronic equipment to said antenna structure effectively at the center of said proximal approximately parallel conductor.

2. The antenna structure of claim 1 wherein the dimensions of said antenna structure are chosen to maximize the performance of said antenna structure in the direction perpendicular to said plane of said antenna structure.

3. The antenna structure of claim 1 wherein the dimensions of said antenna structure are chosen to minimize the performance of said antenna structure in the two directions in said plane of said antenna structure that are perpendicular to said approximately parallel conductors.

4. The antenna structure of claim 1 wherein the dimensions of said antenna structure are chosen to produce a beneficial compromise between maximizing the performance of said antenna structure in the direction perpendicular to said plane of said antenna structure while minimizing the performance in other directions.

5. The antenna structure of claim 1 wherein said approximately parallel conductors are of approximately equal length.

6. The antenna structure of claim 1 wherein said distal approximately parallel conductors are of approximately equal length, and said proximal approximately parallel conductor is of a different length.

7. The antenna structure of claim 1 wherein at least one of the conductors has a circular cross-sectional area.

8. The antenna structure of claim 1 wherein at least one of the conductors has a square cross-sectional area.

9. The antenna structure of claim 1 wherein at least one of the conductors has a rectangular cross-sectional area.

10. The antenna structure of claim 1 wherein at least one of the conductors has a solid cross-sectional area.

11. The antenna structure of claim 1 wherein at least one of the conductors has a tubular cross-sectional area.

12. The antenna structure of claim 1 wherein all the conductors have the same cross-sectional areas.

13. The antenna structure of claim 1 wherein the conductors are not all of the same cross-sectional area.

14. The antenna structure of claim 1 wherein all of the conductors are approximately straight.

15. The antenna structure of claim 1 wherein at least one of the conductors is somewhat curved.

16. The antenna structure of claim 1 wherein said approximately parallel conductors are disposed approximately parallel to the ground.

17. The antenna structure of claim 1 wherein said approximately parallel conductors are disposed approximately perpendicular to the ground.

18. The antenna structure of claim 1 wherein said approximately parallel conductors are disposed neither approximately parallel to the ground nor approximately perpendicular to the ground.

19. The antenna structure of claim 1 further including an approximately straight conductor which connects the three centers of said approximately parallel conductors, but which does not touch the diagonal conductors.

20. An antenna structure, comprising:

(a) three approximately parallel conductors mounted approximately vertically on the ground, approximately in a plane, with approximately equal distances between them;

(b) a first diagonal conductor, connected to the top of the proximal approximately parallel conductor, and extended downward in said plane toward the first distal approximately parallel conductor, until said first diagonal conductor almost meets the ground between said proximal approximately parallel conductor and said distal approximately parallel conductor, thereby producing a triangle, comprising said first diagonal conductor, said proximal approximately parallel conductor, and the ground, which has a perimeter of approximately one wavelength at the operating frequency;

(c) a second diagonal conductor, of approximately the same length as said first diagonal conductor, also connected to the top of said proximal approximately parallel conductor, and extended downward in said plane toward the second distal approximately parallel conductor, until said second diagonal conductor almost meets the ground between said proximal approximately parallel conductor and said second distal approximately parallel conductor, thereby producing a second triangle, comprising said second diagonal conductor, said proximal approximately parallel conductor, and the ground, which has a perimeter of approximately one wavelength at the operating frequency;

(d) a third diagonal conductor, not necessarily of the same length as said first or second diagonal conductors, connected from said first diagonal conductor, where it almost meets the ground, to the top of said first distal approximately parallel conductor, thereby producing a third triangle, comprising said third diagonal conductor, said first distal approximately parallel conductor, and the ground, which has a perimeter of approximately seven-eighths of a wavelength at the operating frequency;

(e) a fourth diagonal conductor, of approximately the same length as said third diagonal conductor, connected from said second diagonal conductor, where it almost meets the ground, to the top of said second distal approximately parallel conductor, thereby producing a fourth triangle, comprising said fourth diagonal conductor, said second distal approximately parallel conductor, and the ground, which has a perimeter of approximately seven-eights of a wavelength at the operating frequency; and (f) means for connecting the associated electronic equipment to said antenna structure effectively at the bottom of said proximal approximately parallel conductor.

21. A combination of at least one antenna array, each of said antenna arrays comprising at least two antenna structures, such that:

(a) each of said antenna structures comprises three approximately parallel conductors, disposed in approximately a plane, separated from each other by approximately equal distances, and aligned so that their centers are approximately on a line that is approximately perpendicular to said approximately parallel conductors;

(b) in each of said antenna structures, two first diagonal conductors, of approximately equal length, connect to the two ends of the proximal approximately parallel conductor, and extend diagonally in said plane toward the first distal approximately parallel conductor, until said first diagonal conductors almost meet each other between said approximately parallel conductors, almost at the line of the centers of said approximately parallel conductors, thereby producing an approximately triangular conductor, comprising said proximal approximately parallel conductor and said first diagonal conductors, which has a perimeter of approximately two wavelengths at the operating frequency;

(c) in each of said antenna structures, two second diagonal conductors, of approximately the same length as said first diagonal conductors, also connect to the two ends of said proximal approximately parallel conductor, and extend diagonally in said plane toward the second distal approximately parallel conductor, until said second diagonal conductors almost meet each other between said approximately parallel conductors, almost at the line of the centers of said approximately parallel conductors, thereby producing a second approximately triangular conductor, comprising said proximal approximately parallel conductor and said second diagonal conductors, which has a perimeter of approximately two wavelengths at the operating frequency;

(d) in each of said antenna structures, two third diagonal conductors, of approximately equal length, but not necessarily the same length as said first or second diagonal conductors, connect from said first diagonal conductors, at the ends where they almost meet, to the two ends of said first distal approximately parallel conductor, without said third diagonal conductors crossing each other, thereby producing a third approximately triangular conductor, comprising said first distal approximately parallel conductor and said third diagonal conductors, which has a perimeter of approximately one and three-quarters wavelengths at the operating frequency;

(e) in each of said antenna structures, two fourth diagonal conductors, of approximately the same length as said third diagonal conductors, connect from said second diagonal conductors, at the ends where they almost meet, to the ends of said second distal approximately parallel conductor, without said fourth diagonal conductors crossing each other, thereby producing a fourth approximately triangular conductor, comprising said second distal approximately parallel conductor and said fourth diagonal conductors, which has a perimeter of approximately one and three-quarters wavelengths at the operating frequency;

(f) in each of said antenna arrays, said planes of said antenna structures are positioned so that the angles between said planes approximately equally divide a circle of 360 degrees;

(g) in each of said antenna arrays, the intersection of said planes of said antenna structures forms a line which passes much nearer than the length of a wavelength at the operating frequency to the centers of all said approximately parallel conductors and to the places where the diagonal conductors almost meet;

(h) except perhaps at said centers of said approximately parallel conductors, said antenna structures do not touch each other;

(i) said antenna structures are connected to the associated electronic equipment effectively at the centers of their proximal approximately parallel conductors;

(j) the means of connecting to said associated electronic equipment is such that the currents in the corresponding conductors of said antenna structures, in each of said antenna arrays, are consistently related in amplitude by approximately the same ratio of values and are consistently unequal in phase by approximately the same amount; and (k) said antenna arrays are aligned so that the line of intersection of said planes of each of said antenna arrays approximately is the line of intersection of said planes of the other antenna arrays.

22. The combination of antenna arrays of claim 21 wherein:

(a) there are just two of said antenna structures in each of said antenna arrays; and (b) the angle between said planes of said antenna structures is approximately 90 degrees.

23. The combination of antenna arrays of claim 22 wherein, in each of said antenna arrays, the means of connecting said two antenna structures to said associated electronic equipment is such that the currents in said corresponding conductors, of said two antenna structures, are approximately equal in amplitude and are approximately a consistent 90 degrees out of phase with each other.

24. The combination of antenna arrays of claim 21 wherein:

(a) there are just three of said antenna structures in each of said antenna arrays;

(b) the angles between said planes of said antenna structures are approximately 60 degrees;

(c) the means of connecting said antenna structures to said associated electronic equipment is such that the currents in said corresponding conductors of said antenna structures are approximately equal in amplitude; and (d) said connecting means is also such that, progressing around the center line of the combination in one particular direction, the pattern of the phases of the currents in said corresponding conductors is approximately zero, 60, 120, 180, 240 and 300 degrees.

25. The combination of antenna arrays of claim 21 wherein there is only one antenna array.

26. The combination of antenna arrays of claim 21 wherein the relative amplitudes and phases of the currents in said corresponding conductors of said antenna arrays and the distances between said antenna arrays are such that the performance is maximized in the principal E plane.

27. The combination of antenna arrays of claim 21 wherein the relative amplitudes and phases of the currents in said corresponding conductors of said antenna arrays and the distances between said antenna arrays are such that the performance is minimized in directions other than in the principal E plane.

28. The combination of antenna arrays of claim 21 wherein the relative amplitudes and phases of the currents in said corresponding conductors of said antenna arrays and the distances between said antenna arrays are such that the performance is a beneficial compromise between maximizing the performance in the principal E plane and minimizing the performance in other directions.

29. A combination of at least one antenna array, each of said antenna arrays comprising at least one antenna structure, such that:

(a) each of said antenna structures comprises three approximately parallel conductors, disposed in approximately a plane, separated from each other by approximately equal distances, and aligned so that their centers are approximately on a line that is approximately perpendicular to said approximately parallel conductors;

(b) in each of said antenna structures, two first diagonal conductors, of approximately equal length, connect to the two ends of the proximal approximately parallel conductor, and extend diagonally in said plane toward the first distal approximately parallel conductor, until said first diagonal conductors almost meet each other between said approximately parallel conductors, almost at the line of the centers of said approximately parallel conductors, thereby producing an approximately triangular conductor, comprising said proximal approximately parallel conductor and said first diagonal conductors, which has a perimeter of approximately two wavelengths at the operating frequency;

(c) in each of said antenna structures, two second diagonal conductors, of approximately the same length as said first diagonal conductors, also connect to the two ends of said proximal approximately parallel conductor, and extend diagonally in said plane toward the second distal approximately parallel conductor, until said second diagonal conductors almost meet each other between said approximately parallel conductors, almost at the line of the centers of said approximately parallel conductors, thereby producing a second approximately triangular conductor, comprising said proximal approximately parallel conductor and said second diagonal conductors, which has a perimeter of approximately two wavelengths at the operating frequency;

(d) in each of said antenna structures, two third diagonal conductors, of approximately equal length, but not necessarily the same length as said first or second diagonal conductors, connect from said first diagonal conductors, at the ends where they almost meet, to the two ends of said first distal approximately parallel conductor, without said third diagonal conductors crossing each other, thereby producing a third approximately triangular conductor, comprising said first distal approximately parallel conductor and said third diagonal conductors, which has a perimeter of approximately one and three-quarters wavelengths at the operating frequency;

(e) in each of said antenna structures, two fourth diagonal conductors, of approximately the same length as said third diagonal conductors, connects from said second diagonal conductors, at the ends where they almost meet, to the ends of said second distal approximately parallel conductor, without said fourth diagonal conductors crossing each other, thereby producing a fourth approximately triangular conductor, comprising said second distal approximately parallel conductor and said fourth diagonal conductors, which has a perimeter of approximately one and three-quarters wavelengths at the operating frequency;

(f) in each of said antenna arrays, said antenna structures are disposed in planes approximately parallel to each other;

(g) in each of said antenna arrays, said approximately parallel conductors are approximately parallel to each other;

(h) in each of said antenna arrays, the centers of said proximal approximately parallel conductors are aligned in the direction perpendicular to said planes of said antenna structures; and (i) in each of said antenna arrays, the associated electronic equipment is connected to a least one of said antenna structures effectively at the center of said proximal approximately parallel conductors of said connected antenna structures.

30. The combination of antenna arrays of claim 29 further including a reflecting screen disposed behind said combination to produce a substantially unidirectional performance to the front of said combination in the direction perpendicular to said planes of said antenna structures.

31. The combination of antenna arrays of claim 29 wherein there is only one of said antenna arrays in said combination.

32. The combination of antenna arrays of claim 29 wherein there is only one of said antenna structures in each of said antenna arrays.

33. The combination of antenna arrays of claim 29 wherein:

(a) there are just two of said antenna structures, with substantially equal dimensions, in each of said antenna arrays; and (b) the manner of connection to said associated electronic equipment is such that the currents in the corresponding conductors of said two antenna structures are approximately equal in amplitude and are approximately 180 degrees out of phase with each other.

34. The combination of antenna arrays of claim 29 wherein:

(a) there are just two of said antenna structures, with substantially equal dimensions, in each of said antenna arrays;

(b) the manner of connection to said associated electronic equipment is such that the currents in the corresponding conductors of said two antenna structures are approximately equal in amplitude; and (c) the distance between said antenna structures and the phase difference between the currents in said corresponding conductors are such that the radiation is minimized in one of the two directions perpendicular to said planes of said antenna structures.

35. The combination of antenna arrays of claim 34 wherein:

(a) the distance between said antenna structures is approximately a free-space quarter wavelength; and (b) the phase difference between the currents in said corresponding conductors is approximately a consistent 90 degrees.

36. The combination of antenna arrays of claim 29 wherein:

(a) there are just two of said antenna structures in each of said antenna arrays;

(b) only the rear antenna structures are connected to said associated electronic equipment; and (c) the dimensions of said antenna structures and the distances between them are such that the performance is substantially unidirectional to the front of said combination of antenna arrays.

37. The combination of antenna arrays of claim 29 wherein:

(a) said approximately parallel conductors of all said antenna arrays are approximately parallel to each other; and (b) said antenna arrays are approximately aligned in the direction of said planes of said antenna structures that is perpendicular to said approximately parallel conductors.

38. The combination of antenna arrays of claim 29 wherein:

(a) said approximately parallel conductors of all said antenna arrays are approximately parallel to each other; and (b) said antenna arrays are approximately aligned in the direction of said planes of said antenna structures that is parallel to said approximately parallel conductors.

39. The combination of antenna arrays of claim 29 wherein:

(a) said approximately parallel conductors of all said antenna arrays are approximately parallel to each other; and (b) said antenna arrays are approximately aligned in the directions of said planes of said antenna structures that are either in the direction perpendicular to said approximately parallel conductors or in the direction parallel to said approximately parallel conductors, thereby producing a rectangular combination.

40. The combination of antenna arrays of claim 29 wherein the relative amplitude and phase of the currents in said antenna arrays and the distances between said antenna arrays are chosen to maximize the performance to the front of said combination.

41. The combination of antenna arrays of claim 29 wherein the relative amplitude and phase of the currents in said antenna arrays and the distances between said antenna arrays are chosen to minimize the performance in directions other than to the front of said combination.

42. The combination of antenna arrays of claim 29 wherein the relative amplitude and phase of the currents in said antenna arrays and the distances between said antenna arrays are chosen to produce a beneficial compromise between maximizing the performance toward the front of said combination and minimizing the performance in other directions.

43. The combination of antenna arrays of claim 29 wherein said antenna arrays are substantially the same as each other in the dimensions of their conductors and the distances between their conductors.

44. The combination of antenna arrays of claim 43 wherein:

(a) each of said antenna structures in each of said antenna arrays is approximately in the same plane as corresponding antenna structures in the other antenna arrays;

(b) the first half of said antenna arrays have approximately parallel conductors that are orientated perpendicular to said approximately parallel conductors of the second half of said antenna arrays; and (c) the manner of connection to said associated electronic equipment is such that the currents in the conductors of said first half of said antenna arrays are approximately equal in amplitude and consistently out of phase by approximately 90 degrees to the currents in corresponding conductors of said second half of said antenna arrays, thereby producing an approximately circularly polarized combination.

45. The combination of antenna arrays of claim 44 wherein:

(a) said antenna arrays are arranged in pairs, each of said pairs having approximately parallel conductors of the two orientations; and (b) said antenna arrays are arranged so that the centers of the corresponding proximal approximately parallel conductors of each of said pairs of antenna arrays are much closer to each other than the length of a wavelength at the operating frequency.

46. The combination of antenna arrays of claim 43 wherein:

(a) the first half of said antenna arrays have approximately parallel conductors that are orientated perpendicular to the approximately parallel conductors of the second half of said antenna arrays;

(b) said antenna arrays are arranged in pairs, each of said pairs having approximately parallel conductors of the two orientations;

(c) in each of said pairs, the centers of said proximal approximately parallel conductors of both antenna arrays are aligned with each other;

(d) in each of said pairs, the currents in the corresponding conductors of said two antenna arrays are equal in amplitude; and (e) in each of said pairs, the perpendicular distances between said planes of said corresponding antenna structures and the phase relationship between the currents in said corresponding conductors are such that approximately circularly polarized radiation is produced to the front of said combination.

47. The combination of antenna arrays of claim 29 wherein:

(a) in each of said antenna arrays only the second of said antenna structures from the rear is connected to said associated electronic equipment; and (b) the dimensions of said antenna structures and the distances between said antenna structures are such that the performance is substantially unidirectional to the front of said combination.

48. The combination of antenna arrays of claim 47 wherein the dimensions of said antenna structures and the distances between said antenna structures produce the maximum performance to the front of said combination.

49. The combination of antenna arrays of claim 47 wherein the dimensions of said antenna structures and the distances between said antenna structures produce the minimum performance in directions other than to the front of said combination.

50. The combination of antenna arrays of claim 47 wherein the dimensions of said antenna structures and the distances between said antenna structures produce a beneficial compromise between maximizing the performance toward the front of said combination and minimizing the performance in other directions.

* * * * *